US009662873B2

(12) United States Patent
Kamoda

(10) Patent No.: US 9,662,873 B2
(45) Date of Patent: May 30, 2017

(54) COMBINATION PRINTER

(71) Applicant: KOMORI CORPORATION, Tokyo (JP)

(72) Inventor: Hiroyoshi Kamoda, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 14/957,366

(22) Filed: Dec. 2, 2015

(65) Prior Publication Data

US 2016/0082713 A1 Mar. 24, 2016

Related U.S. Application Data

(63) Continuation of application No. 14/344,856, filed as application No. PCT/JP2012/073253 on Sep. 12, 2012.

(30) Foreign Application Priority Data

Sep. 14, 2011 (JP) ..... 2011-200127
Sep. 14, 2011 (JP) ..... 2011-200128
Sep. 7, 2012 (JP) ..... 2012-196784

(51) Int. Cl.
*B41F 5/00* (2006.01)
*B41F 3/02* (2006.01)
(Continued)

(52) U.S. Cl.
CPC ..... *B41F 3/02* (2013.01); *B41F 7/02* (2013.01); *B41F 9/02* (2013.01); *B41F 11/00* (2013.01); *B41F 11/02* (2013.01)

(58) Field of Classification Search
CPC ..... B41F 11/00; B41F 16/0013; B41F 19/00; B41F 13/085; B41F 3/02; B41F 11/02; B41F 7/02; B41F 9/02
See application file for complete search history.

(56) References Cited

U.S. PATENT DOCUMENTS 5,042,378 A 8/1991 Germann
5,461,977 A 10/1995 Germann
(Continued)

FOREIGN PATENT DOCUMENTS

EP 0 351 366 A2 1/1990
EP 0906826 A2 4/1999
(Continued)

*Primary Examiner* — Matthew G Marini
(74) *Attorney, Agent, or Firm* — Birch, Stewart, Kolasch & Birch, LLP

(57) ABSTRACT

An Orlof printing section (2) is provided with an Orlof printing unit that has the following: partial plate cylinders (11), a collecting blanket cylinder (12), a collecting plate cylinder (13), a blanket cylinder (9), an impression cylinder (10), and a moving inker (25). An offset printing section (3) is provided with front-side and back-side offset printing units (**3*a*-3*d*, 3*e*-3*h*) that each have an ink-supply device (18), a plate cylinder (19), a blanket cylinder (15), and an impression cylinder (16). The respective impression cylinders of the front-side offset printing unit and the back-side offset printing unit are placed up against each other such that said printing units receive and output sheets between said impression cylinders. The offset printing section (3) is also provided with a front-side inspection camera (23) and a back-side inspection camera (24). The Orlof printing section and the offset printing section are connected by transfer cylinders (14**).

3 Claims, 8 Drawing Sheets

(51) Int. Cl.

| | |
|---|---|
| ***B41F 11/02*** | (2006.01) |
| ***B41F 7/02*** | (2006.01) |
| ***B41F 9/02*** | (2006.01) |
| ***B41F 11/00*** | (2006.01) |

(56) References Cited

U.S. PATENT DOCUMENTS

| | | | |
|---|---|---|---|
| 6,272,987 | B1 | 8/2001 | Kamoda |
| 6,431,065 | B1 | 8/2002 | Demi et al. |
| 2001/0009358 | A1 | 7/2001 | Fujiwara et al. |
| 2007/0181016 | A1 | 8/2007 | Schaede |
| 2010/0294149 | A1 | 11/2010 | Kusaka |

FOREIGN PATENT DOCUMENTS

| | | | | |
|---|---|---|---|---|
| EP | 1323529 | A1 | | 7/2003 |
| GB | 2095622 | A | * | 10/1982 |
| GB | 2 244 456 | A | | 12/1991 |
| JP | 58-101057 | A | | 6/1983 |
| JP | S60-15158 | A | | 1/1985 |
| JP | 64-42135 | U | | 3/1989 |
| JP | 2-22057 | A | | 1/1990 |
| JP | 2-72952 | A | | 3/1990 |
| JP | 2-187337 | A | | 7/1990 |
| JP | 4-224946 | A | | 8/1992 |
| JP | 7-291 | Y2 | | 1/1995 |
| JP | 7-17019 | A | | 1/1995 |
| JP | 7-251495 | A | | 10/1995 |
| JP | 10-100368 | A | | 4/1998 |
| JP | 11-5292 | A | | 1/1999 |
| JP | 2000-62134 | A | | 2/2000 |
| JP | 2000-127349 | A | | 5/2000 |
| JP | 2000-215297 | A | | 8/2000 |
| JP | 2000-301687 | A | | 10/2000 |
| JP | 2001-199051 | A | | 7/2001 |
| JP | 2003-127321 | A | | 5/2003 |
| JP | 2004-34641 | A | | 2/2004 |
| JP | 2008-501547 | A | | 1/2008 |
| JP | 2010-269447 | A | | 12/2010 |
| WO | WO 2005/118294 | A1 | | 12/2005 |

* cited by examiner

COMBINATION PRINTER

This application is a Continuation of co-pending application Ser. No. 14/344,856 filed on Jul. 31, 2014, which was filed as a PCT International Application No. PCT/JP2012/073253 on Sep. 12, 2012, which claims the benefit under 35 U.S.C. §119 to Patent Application No. 2011-200127, filed in Japan on Sep. 14, 2011, Patent Application No. 2011-200128, filed in Japan on Sep. 14, 2011, and Patent Application No. 2012-196784, filed in Japan on Sep. 7, 2012, all of which are hereby expressly incorporated by reference into the present application.

TECHNICAL FIELD

The present invention relates to an offset collect-printing press configured such that the single printing press alone can perform both collect-printing and offset printing.

BACKGROUND ART

Complex combinations of printing methods including intaglio printing, relief printing, and lithographic printing are used for printing securities and the like for the purpose of counterfeit prevention and so forth. Intaglio printing by which fine and sharp images can be obtained is used for portraits and denominations. Relief printing by which legible and sharp letters can be printed is used for serial numbers. Lithographic (offset) printing suitable for multi-color printing is used for background patterns. Further, a special printing method called collect-printing is employed for part of the background patterns.

The collect-printing is a printing method in which inks in different colors are attached respectively onto multiple pattern plate cylinders, and then the inks on the pattern plate cylinders are collected onto a collecting plate cylinder via a collecting blanket cylinder and are transferred further onto a sheet of paper passing between a blanket cylinder and an impression cylinder. This collect-printing has a great counterfeit prevention effect because the collect-printing has such a characteristic that no registration error occurs at all even when colors are changed in the middle of an image.

FIG. 8 shows a multi-color collect-printing press used for printing background patterns. In this printing press, three pattern plate cylinders (collect-printing pattern plate cylinders) 01, a collecting blanket cylinder (a collect-printing collecting blanket cylinder) 02, a collecting plate cylinder (a collect-printing collecting plate cylinder) 03, a blanket cylinder 04, and an impression cylinder 05 are connected in this order. Images on the respective pattern plate cylinders 01 are transferred to and integrated on the collecting plate cylinder 03 via the collecting blanket cylinder 02, and are further printed, via the blanket cylinder 04, on a sheet of paper that is fed from a not-illustrated sheet feeder to a space between the blanket cylinder 04 and the impression cylinder 05 via a swing 06. The printed sheet of paper is conveyed from a delivery cylinder 07 to a not-illustrated delivery device (see Patent Document 1).

While an offset printing press and a collect-printing press may be used in combination for printing background patterns, this configuration has a disadvantage of high installation costs because both of the printing presses have structures that are large in size. The configuration has another problem which is an increase in load on an operator when he or she conveys printed products on a palette from a delivery unit of the collect-printing press to a sheet feeder unit of the offset printing press with a forklift or the like while keeping the products away from collapsing.

The applicant of the present invention has previously proposed combination printing presses as described in Patent Documents 2 and 3, for example, which can perform both offset printing and collect-printing.

PRIOR ART DOCUMENTS

Patent Documents

Patent Document 1: Japanese Examined Utility Model Registration Application Publication No. Hei 7-291
Patent Document 2: Japanese Patent Application Publication No. Hei 2-22057
Patent Document 3: Japanese Patent Application Publication No. 2003-127321
Patent Document 4: Japanese Patent Application Publication No. Hei 7-17019
Patent Document 5: Japanese Utility Model Registration Application Publication No. Hei 1-42135

SUMMARY OF THE INVENTION

Problems to be Solved by the Invention

However, the invention described in Patent Document 2 has a disadvantage that its use is limited to double-sided multi-color printing. In addition, this invention employs a structure in which a collect-printing collecting plate cylinder, a collect-printing collecting blanket cylinder, collect-printing pattern plate cylinders, and so forth are arranged around at least one of a pair of collecting blanket cylinders. Accordingly, this invention has a problem of an extremely complicated structure of the printing press which makes it difficult to perform printing preparation work and maintenance work.

On the other hand, the invention described in Patent Document 2 has a problem that its use is limited to single-sided printing.

In view of the above, an object of the present invention is to provide a combination printing press configured such that the single printing press having a simple structure alone can perform both offset printing and collect-printing and that the printing press allows arbitrary selection between double-sided offset printing and single-sided offset printing when the offset printing is performed.

Means for Solving the Problems

In order to achieve the above object, a combination printing press according to the present invention is a combination printing press including a collect-printing section configured to perform collect-printing on a sheet and an offset printing section configured to perform offset printing on the sheet, wherein the collect-printing section comprises a collect-printing unit including:

a plurality of pattern plate cylinders;

a collecting blanket cylinder with which the plurality of pattern plate cylinders are in contact;

a collecting plate cylinder in contact with the collecting blanket cylinder;

a blanket cylinder in contact with the collecting plate cylinder;

an impression cylinder in contact with the blanket cylinder; and a movable inking unit configured to support a plurality of inking devices provided respectively corresponding to the plurality of pattern plate cylinders so as to supply inks to the pattern plate cylinders, in such away as to be capable of moving the inking devices to and away from the pattern plate cylinders, the offset printing section comprises:

an obverse-side offset printing unit including an ink supply device, a plate cylinder, a blanket cylinder, and an impression cylinder and being configured to perform offset printing on an obverse side of the sheet; and a reverse-side offset printing unit including an ink supply device, a plate cylinder, a blanket cylinder, and an impression cylinder and being configured to perform offset printing on a reverse side of the sheet, the impression cylinders of the obverse-side offset printing unit and the reverse-side offset printing unit are in contact with each other in such a way that the sheet is passed on between the impression cylinders of the obverse-side and reverse-side offset printing units, the combination printing press further comprises an inspection apparatus configured to inspect printing quality on the obverse side and the reverse side of the sheet, and the collect-printing section and the offset printing section are connected to each other through one or a plurality of transfer cylinders.

In addition, in the combination printing press, the obverse-side offset printing unit comprises a double-duct ink supply device including two ink fountains.

Additionally, in the combination printing press, the reverse-side offset printing unit comprises a double-duct ink supply device including two ink fountains.

Moreover, in the combination printing press, the blanket cylinder of any one of the obverse-side offset printing unit and the reverse-side offset printing unit is arranged in such a way that the blanket cylinder passes the sheet onto its adjacent cylinder after completion of printing on the sheet of the largest length printable with the printing press.

Further, in the combination printing press, in the collect-printing unit, the collecting blanket cylinder is formed as a triple-size cylinder having a diameter three times as large as a diameter of each pattern plate cylinder, each of the collecting plate cylinder and the blanket cylinder is formed as a single-size cylinder having the same diameter as each pattern plate cylinder, and the impression cylinder is formed as a double-size cylinder having a diameter twice as large as the diameter of each pattern plate cylinder, the pattern plate cylinders are arranged with an interval to define a work space between adjacent ones of the pattern plate cylinders which allows an access to the collecting blanket cylinder, the access to the collecting blanket cylinder through the work space and an access to the blanket cylinder are enabled from a first space defined between the collect-printing unit and the movable inking unit, an access to an inside of the printing press is enabled from a second space at an opposite side of the collect-printing unit from the first space, and the impression cylinder, the blanket cylinder, and the collecting plate cylinder are arranged in such a way that a circumferential length of the blanket cylinder between positions of contact of the blanket cylinder with the collecting plate cylinder and the impression cylinder is equal to or below a non-printing length obtained by subtracting an effective printing length from an entire circumferential length of the blanket cylinder.

Furthermore, in the combination printing press, an angle defined downstream, in a rotation direction of the blanket cylinder, of the position of contact between the impression cylinder and the blanket cylinder by a line segment connecting a center of the impression cylinder to a center of the blanket cylinder and a line segment connecting a center of the blanket cylinder to a center of the collecting plate cylinder is set in such a way that the circumferential length between the positions of contact of the blanket cylinder with the collecting plate cylinder and the impression cylinder is equal to or below the non-printing length obtained by subtracting the effective printing length from the entire circumferential length of the blanket cylinder.

In addition, in the combination printing press, an angle defined upstream, in a rotation direction of the blanket cylinder, of the position of contact between the impression cylinder and the blanket cylinder by a line segment connecting a center of the impression cylinder to a center of the blanket cylinder and a line segment connecting a center of the blanket cylinder to a center of the collecting plate cylinder is set in such a way that the circumferential length between the positions of contact of the blanket cylinder with the collecting plate cylinder and the impression cylinder is equal to or below the non-printing length obtained by subtracting the effective printing length from the entire circumferential length of the blanket cylinder.

Moreover, in the combination printing press, the printing press comprises:

a sheet feeder device configured to feed the sheet to the collect-printing unit; and a first transfer cylinder and a second transfer cylinder provided between the sheet feeder device and the impression cylinder of the collect-printing unit, the first transfer cylinder including a skewing adjustment mechanism configured to incline a shaft center of the first transfer cylinder relative to a shaft center of its adjacent cylinder, and the second transfer cylinder including a circumferential adjustment mechanism configured to adjust a phase of the second transfer cylinder relative to its adjacent cylinder.

Further, in the combination printing press, the printing press is provided with an inkjet device configured to perform printing on the sheet being held and conveyed by the first and second transfer cylinders provided between the sheet feeder device and the impression cylinder of the collect-printing unit.

Furthermore, in the combination printing press, the printing press comprises an intaglio printing unit connected to the impression cylinder of any one of the collect-printing unit, the obverse-side offset printing unit, and the reverse-side offset printing unit via at least one transfer cylinder and configured to perform intaglio printing on the sheet.

Effect of the Invention

According to the combination printing press of the present invention, the single printing press having a simple structure alone can perform both offset printing and collect-printing, and the printing press allows arbitrary selection between double-sided offset printing and single-sided offset printing when the offset printing is performed. Thus, it is possible to perform various types of printing by a single sheet conveyance operation of the single printing press, and to achieve high-quality printing with high register accuracy.

MODES FOR CARRYING OUT THE INVENTION

Embodiments of a combination printing press according to the present invention will be described below in detail with reference to the drawings.

First Embodiment

Figure 1:
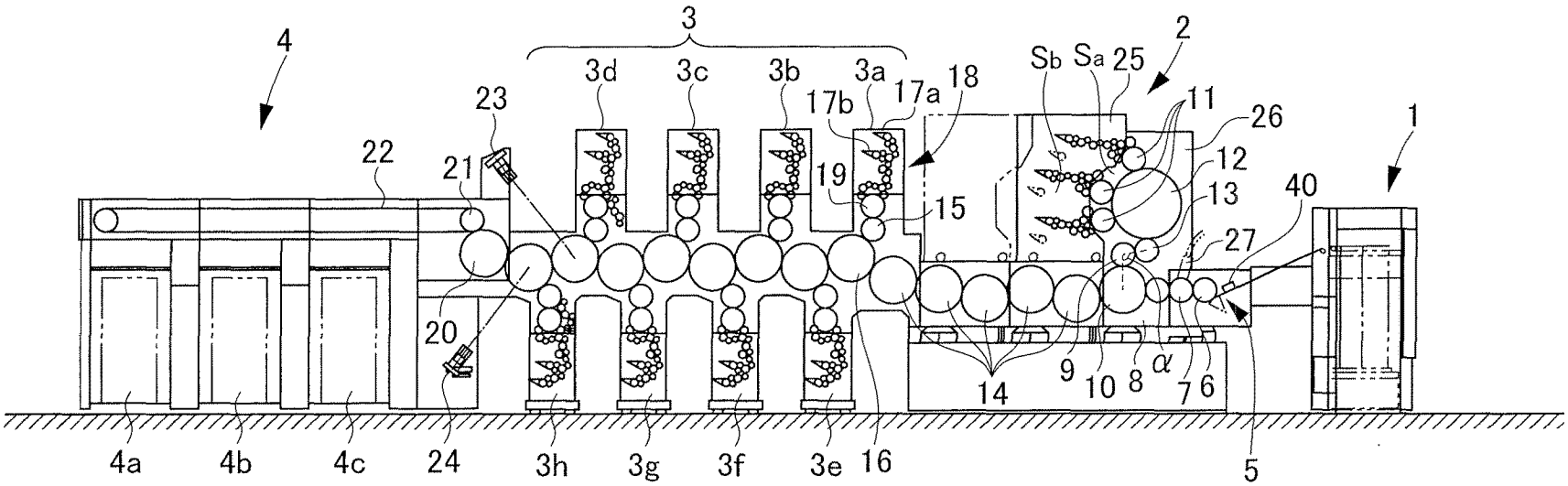
FIG. 1 is an overall configuration diagram of a combination printing press including a collect-printing press, which shows a first embodiment of the present invention.
Figure 2:
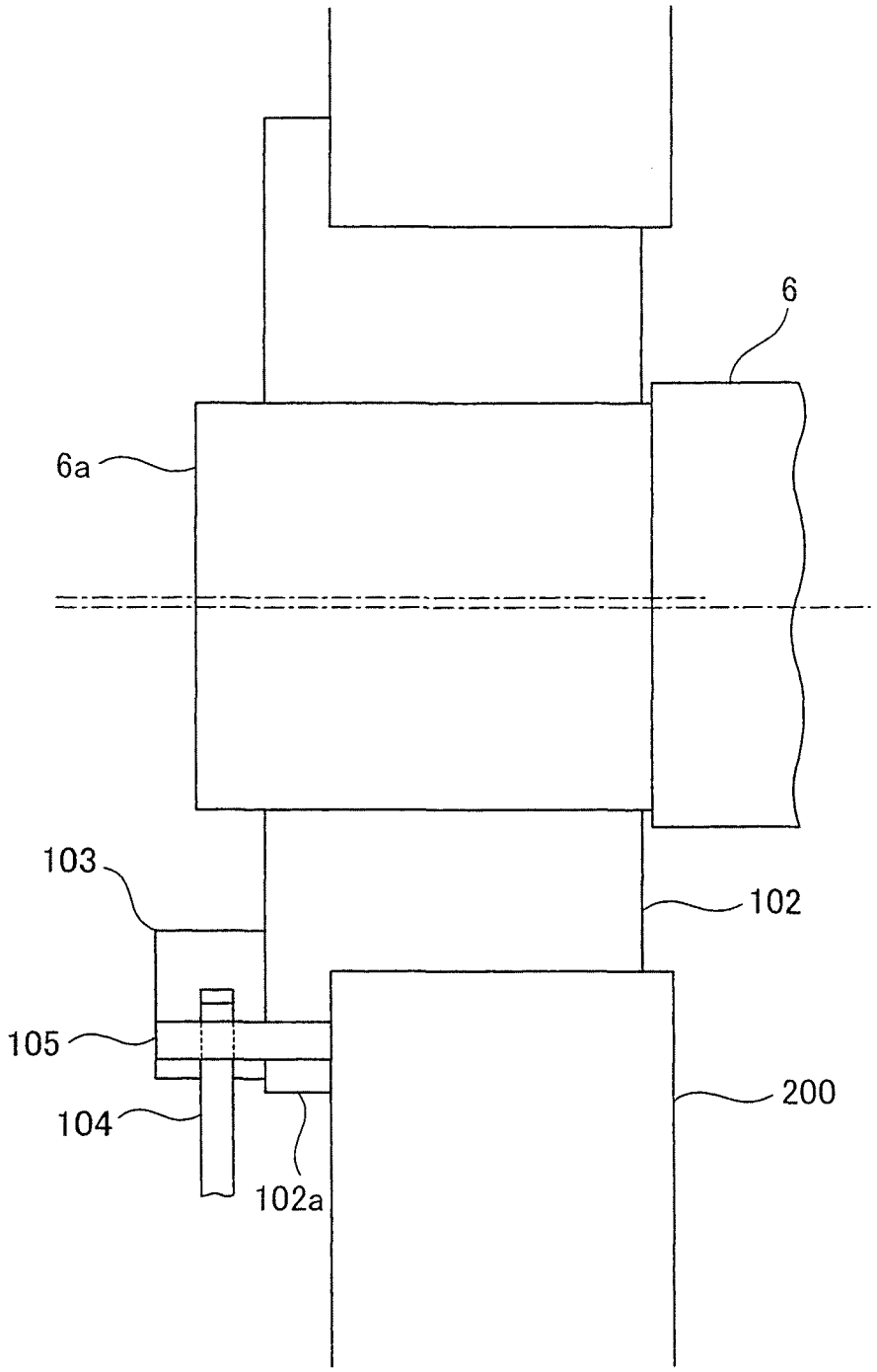
FIG. 2 is a structural explanatory view of a skewing adjustment mechanism.
Figure 3:
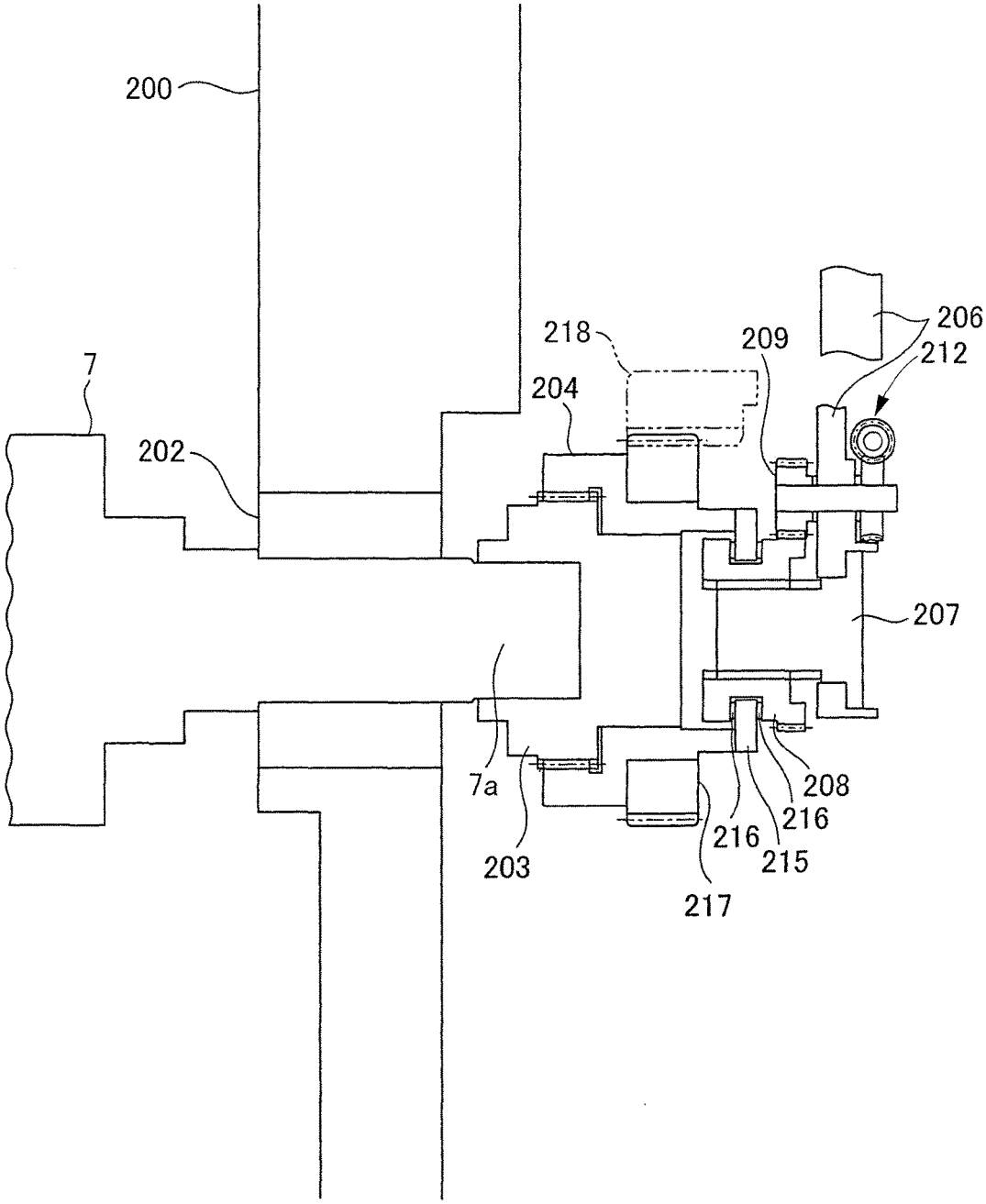
FIG. 3 is a structural explanatory view of a circumferential adjustment mechanism.
Figure 4A:
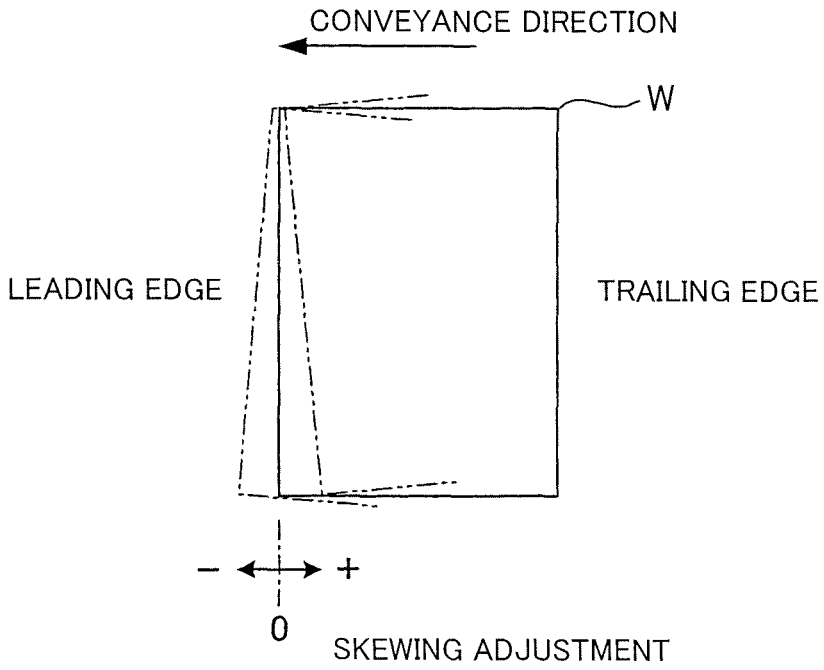
FIG. 4A is an operational explanatory view of the skewing adjustment mechanism.
Figure 4B:
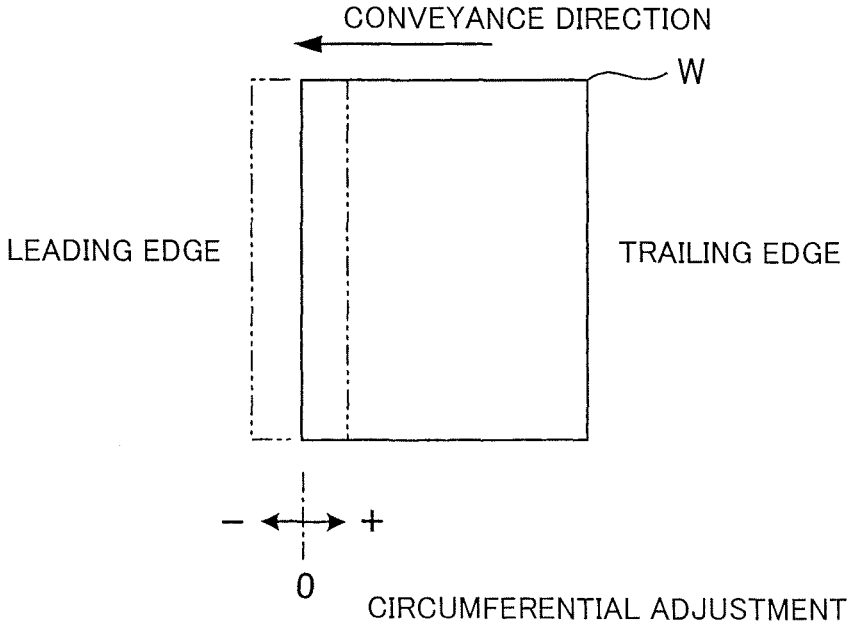
FIG. 4B is an operational explanatory view of the circumferential adjustment mechanism.
Figure 5A:
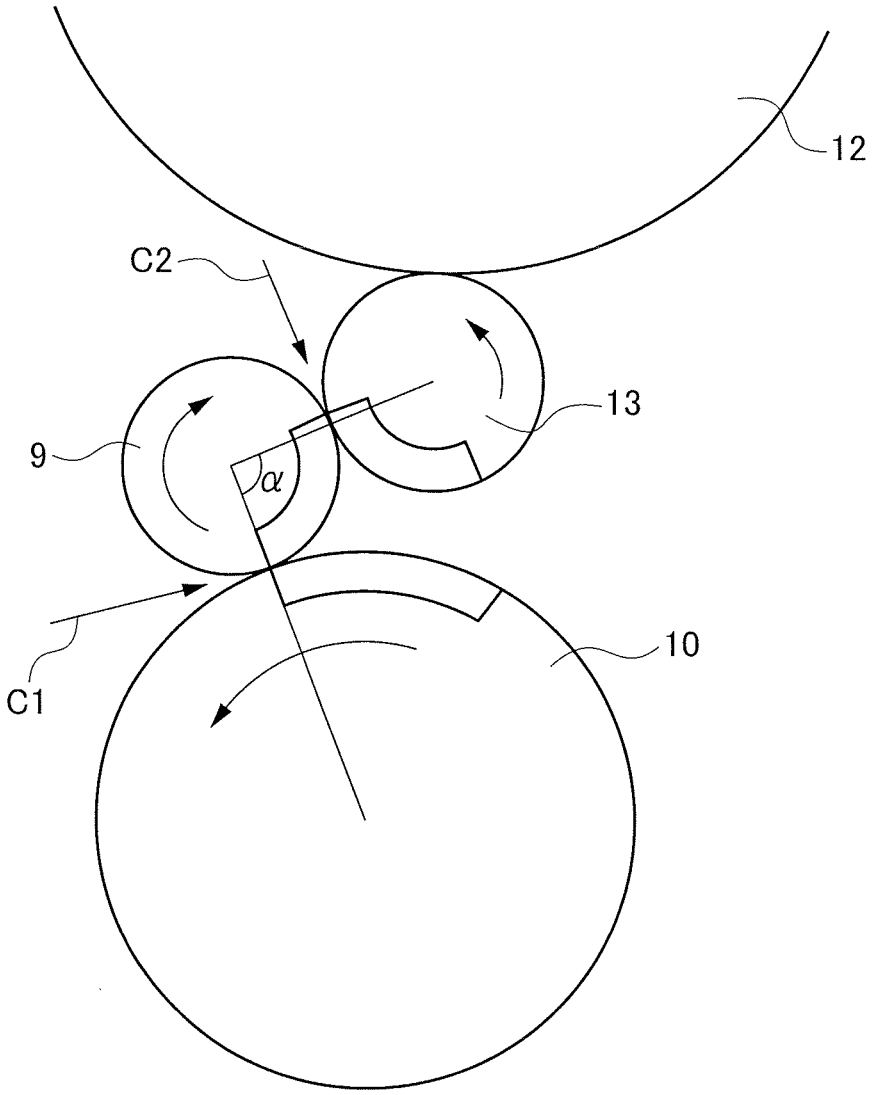
FIG. 5A is an explanatory view of an arrangement of cylinders in a collect-printing unit.

FIG. 1 is an overall configuration diagram of a combination printing press showing a first embodiment of the present invention, FIG. 2 is a structural explanatory view of a skewing adjustment mechanism, FIG. 3 is a structural explanatory view of a circumferential adjustment mechanism, FIG. 4A is an operational explanatory view of the skewing adjustment mechanism, FIG. 4B is an operational explanatory view of the circumferential adjustment mechanism, and FIG. 5A is an explanatory view of an arrangement of cylinders in a collect-printing unit.

As shown in FIG. 1, a feeder section 1 as a sheet feeder unit to feed paper as sheets, a collect-printing section 2, an offset printing section 3, and a delivery section 4 as a sheet delivery unit are arranged sequentially from the right. First, sheets of paper are passed one by one from the feeder section 1 onto an impression cylinder 10 of the collect-printing section 2 by a swing 5 and via three transfer cylinders 6, 7, and 8, and are fed in between a blanket cylinder 9 and the impression cylinder 10 of the collect-printing section 2.

In the collect-printing section 2, three pattern plate cylinders 11, a collecting blanket cylinder 12, a collecting plate cylinder 13, the blanket cylinder 9, and the impression cylinder 10 are sequentially arranged from above. Images on the respective pattern plate cylinders 11 are transferred to and integrated on the collecting plate cylinder 13 via the collecting blanket cylinder 12, and are further printed, via the blanket cylinder 9, on a sheet of paper fed in between the blanket cylinder 9 and the impression cylinder 10.

Next, the collect-printed sheet of paper is sent from the impression cylinder 10, passed through five transfer cylinders 14, and fed in between a blanket cylinder 15 and an impression cylinder 16 of a first-color offset printing unit 3*a* of the offset printing section 3.

The offset printing section 3 includes eight offset printing units 3*a* to 3*h*. Each unit includes: a double-duct ink supply device 18 provided with two ink fountains 17*a* and 17*b*; a plate cylinder 19; the blanket cylinder 15; and the impression cylinder 16. Images in given colors transferred from the respective plate cylinders 19 are printed on the sheet of paper fed in between the blanket cylinders 15 and the impression cylinders 16.

Here, adjacent offset printing units 3*a* to 3*h* are connected in such a way that the two impression cylinders 16 are in contact with each other. After the offset printing unit 3*a* performs offset printing on one surface (an obverse side) of the sheet of paper, the sheet of paper is passed from the impression cylinder 16 of the offset printing unit 3*a* to the impression cylinder 16 of the offset printing unit 3*e*, and the offset printing unit 3*e* performs offset printing on the other surface (a reverse side) of the sheet of paper. Thus, the impression cylinders of the adjacent offset printing units are in contact without interposing transfer cylinders therebetween, whereby the sheet of paper is subjected to obverse-side printing and reverse-side printing alternately. Here, the offset printing units 3*a* to 3*d* are obverse-side offset printing units which perform offset printing on the obverse side of the sheet of paper, and the offset printing units 3*e* to 3*h* are reverse-side offset printing units which perform offset printing on the reverse side of the sheet of paper.

Lastly, the offset-printed sheets of paper are passed from the impression cylinder 16 of the fourth-color reverse-side offset printing unit 3*h* to a delivery cylinder 21 via a transfer cylinder 20, sequentially conveyed to the delivery section 4 by a delivery chain 22, and stacked on any of piles to be described later.

Here, an obverse-side inspection camera 23 and a reverse-side inspection camera 24 as inspection apparatuses are provided to be directed to the impression cylinder 16 of the fourth-color obverse-side offset printing unit 3*d* and to the impression cylinder 16 of the fourth-color reverse-side offset printing unit 3*h*, respectively. Each sheet of paper is subjected to an inspection of printing quality on the obverse side in the course of conveyance on the impression cylinder 16 of the obverse-side offset printing unit 3*d*, and to an inspection of printing quality on the reverse side in the course of conveyance on the impression cylinder 16 of the reverse-side offset printing unit 3*h*. As a result of the inspections by the inspection cameras 23 and 24, the sheet of paper determined as normal is delivered onto any one of normal sheet piles 4*b* and 4*c*, for example, in the delivery section 4 while the sheet of paper determined as defective is delivered onto a defective sheet pile 4*a*, for example, in the delivery section 4.

Meanwhile, in the embodiment, a movable inking unit 25 provided with inking devices to supply inks to the pattern cylinders 11 is arranged in the collect-printing section 2 in such a manner as to be horizontally movable above the five transfer cylinders 14 (on a printing press frame) (see a chain line in the drawing), and to be capable of moving the inking devices to and away from (attaching and detaching the inking devices to and from) a collect-printing unit 26 pivotally supporting the three pattern plate cylinders 11, the collecting blanket cylinder 12, the collecting plate cylinder 13, the blanket cylinder 9, and the impression cylinder 10. Here, the multiple inking devices are provided corresponding to the respective pattern plate cylinders 11. In the meantime, reference numeral 40 in the drawing denotes a pair of side lay devices provided in a lateral direction on a feedboard whose positions in the lateral direction are automatically adjusted depending on the sheet size of the sheet of paper.

Being configured as described above, the offset printing in four colors on the obverse side as well as in four colors on the reverse side is performed in-line after collect-printing in three colors. For example, the offset printing can be performed only on the obverse side by separating (detaching) the blanket cylinders 15 of the reverse-side offset printing units 3*e* to 3*h* from the impression cylinders 16 and the plate cylinders 19 thereof. Thus, it is possible to perform the double-sided offset printing or the single-sided offset printing only on an arbitrary side. In this way, the single printing press can perform printing of various combinations.

In addition, the collecting blanket cylinder 12 of the collect-printing section 2 is formed as a triple-size cylinder having a diameter three times as large as the diameter of each pattern plate cylinder 11. In the illustrated example, the pattern plate cylinders 11 in contact with a downstream side in a sheet conveyance direction (a delivery device side) of the collecting blanket cylinder 12 are arranged in such away that an interval between the pattern plate cylinder 11 located in the highest position among the three pattern plate cylinders 11 and the pattern plate cylinder 11 located immediately therebelow is made larger than an interval between the pattern plate cylinders 11 other than the highest pattern plate cylinder 11. The interval between the pattern plate cylinder 11 located in the highest position and the pattern plate cylinder 11 located immediately therebelow defines a work space Sa, and the collecting blanket cylinder 12 is accessible through the work space Sa without dismounting the pattern plate cylinders 11.

Specifically, in an illustrated separation position of the movable inking unit 25 (a position indicated with the chain line in the drawing), an operator located in a space Sb defined between the inking devices and the pattern plate cylinders 11 (the sheet delivery device side of the collect-printing unit 26) can perform maintenance work, such as cleaning work and blanket replacement work on the collecting blanket cylinder 12, from the space Sb defined between the movable inking unit 25 and the pattern plate cylinders 11 through the work space Sa.

Accordingly, it is possible to access the collecting blanket cylinder 12 by use of the work space Sa defined between the adjacent pattern plate cylinders 11 without mounting and dismounting the pattern plate cylinders 11 at the time of maintenance such as the cleaning work and the blanket replacement work on the collecting blanket cylinder 12. This improves workability of the maintenance work on the collecting blanket cylinder 12.

In the meantime, each of the collecting plate cylinder 13 and the blanket cylinder 9 of the collect-printing section 2 is formed as a single-size cylinder having the same diameter as each pattern plate cylinder 11, while the impression cylinder 10 is formed as a double-size cylinder having a diameter twice as large as the diameter of each pattern plate cylinder 11. The cylinders are arranged in such a way that the collecting plate cylinder 13 is disposed immediately below the collecting blanket cylinder 12, the blanket cylinder 9 is disposed downstream in the sheet conveyance direction (the delivery device side) of the collecting plate cylinder 13, and the impression cylinder 10 is disposed immediately below the blanket cylinder 9.

Accordingly, a sufficient work space is secured on an upstream side in the sheet conveyance direction (a feeder device side) of the collecting plate cylinder 13. Thus, plates can be replaced from the upstream side in the sheet conveyance direction (the feeder device side) of the collect-printing unit 26. Meanwhile, the sufficient work space is secured on the downstream side in the sheet conveyance direction (the delivery device side) of the blanket cylinder 9. Thus, the maintenance such as the cleaning work and the blanket replacement work can be performed from the downstream side in the sheet conveyance direction (the delivery device side) of the collect-printing unit 26.

In the conventional configuration, a worker would have to work on the upstream side in the sheet conveyance direction (the feeder device side) of the collect-printing unit when cleaning the collecting blanket cylinder and to work on the downstream side in the sheet conveyance direction (the delivery device side) of the collect-printing unit when cleaning the blanket cylinder, whereby the worker would suffer an increase in load and an increase in work time. While it is necessary to clean the collecting blanket cylinder 12 and the blanket cylinder 9 in one job, the configuration of the present invention enables the operator to clean the collecting blanket cylinder 12 and the blanket cylinder 9 while remaining in the space Sb defined between the movable inking unit 25 and the pattern plate cylinders 11. Thus, it is possible to improve workability by reducing loads on the worker, and to improve productivity by reducing preparation time.

Further, the impression cylinder 10, the blanket cylinder 9, and the collecting plate cylinder 13 of the collect-printing section 2 are arranged in such a way that a circumferential length of the blanket cylinder 9 between positions of contact with the collecting plate cylinder 13 and the impression cylinder 10 is equal to or below a non-printing length obtained by subtracting an effective printing length from the entire circumferential length of the blanket cylinder 9. Specifically, an angle $\alpha$ on the upstream side in the sheet conveyance direction (the sheet feeder side) defined between a line segment connecting the center of the impression cylinder 10 to the center of the blanket cylinder 9 and a line segment connecting the center of the blanket cylinder 9 to the center of the collecting plate cylinder 13 is set in such a way that the circumferential length from the position of contact of the blanket cylinder 9 with the collecting plate cylinder 13 to the position of contact of the blanket cylinder 9 with the impression cylinder 10 (a distance of conveyance of an ink from a point where the ink is received from the collecting plate cylinder 13 to a point where the ink is printed on a sheet of paper) becomes equal to or below the length (the non-printing length) obtained by subtracting the effective printing length (a length in the circumferential direction of the largest printing pattern printable with the printing press) from the entire circumferential length of the blanket cylinder 9.

In the meantime, as shown in FIG. 5A, a printing pressure (C2≈0.05 mm) between the blanket cylinder 9 and the collecting plate cylinder 13 is set lower than a printing pressure (C1≈0.15 mm) between the blanket cylinder 9 and the impression cylinder 10. Accordingly, a shock generated when the printing pressure between the blanket cylinder 9 and the impression cylinder 10 is released due to passage of a trailing edge of the sheet of paper out of a space between the cylinders 9 and 10 causes a phenomenon to rotate the blanket cylinder 9 in its rotation direction or brake it forcibly, whereby the blanket cylinder 9 is displaced (slipped) relative to the collecting plate cylinder 13 in the circumferential direction.

Figure 7:
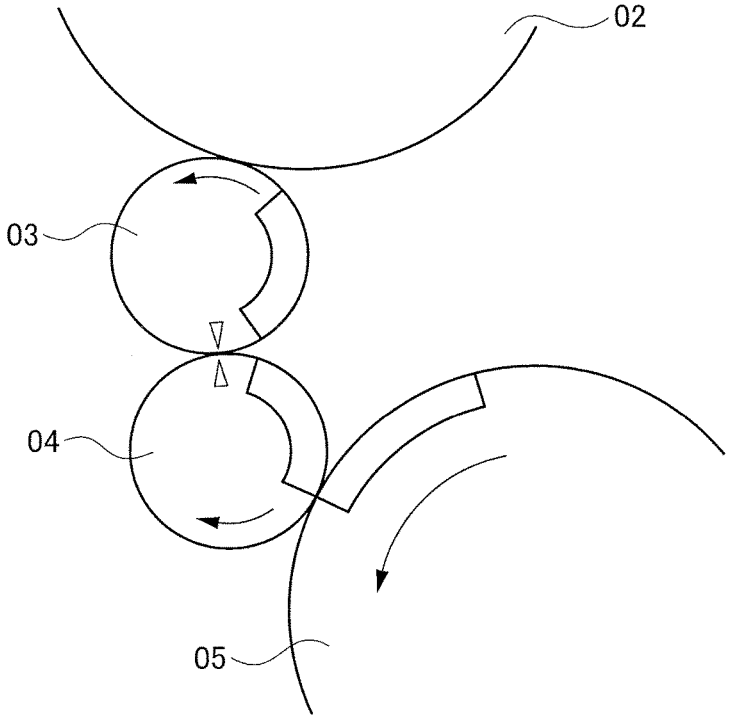
FIG. 7 is an explanatory view of an arrangement of cylinders in a conventional collect-printing unit.
Figure 8:
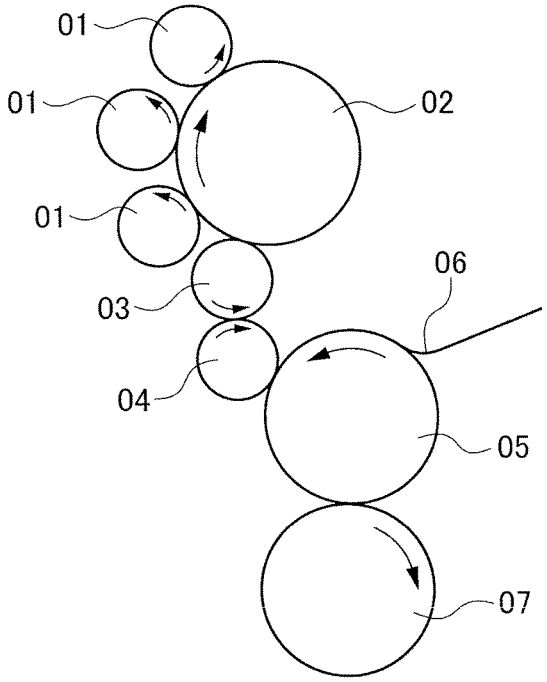
FIG. 8 is a schematic configuration diagram of a conventional multi-color collect-printing press.

In this regard, in the conventional configuration as in FIG. 7 where the angle $\alpha$ is set in such a way that the circumferential length from the position of contact of the blanket cylinder 04 with the collecting plate cylinder 03 to the position of contact of the blanket cylinder 04 with the impression cylinder 05 (the distance of conveyance of an ink from the point where the ink is received from the collecting plate cylinder 03 to the point where the ink is printed on a sheet of paper) does not become equal to or below the length (the non-printing length) obtained by subtracting the effective printing length (the length in the circumferential direction of the largest printing pattern printable with the printing press) from the entire circumferential length of the blanket cylinder 04, effective impression areas (portions of the surfaces where the ink is transferred from the blanket cylinder 04 to the collecting blanket cylinder 03) of the blanket cylinder 04 and the collecting plate cylinder 03 are in contact with each other when the printing pressure between the blanket cylinder 9 and the impression cylinder 10 is released. As a consequence, uneven ink transfer occurs due to the displacement of the blanket cylinder 04 relative to the collecting blanket cylinder 03 in the circumferential direction, thereby leading to a printing trouble.

On the other hand, in the configuration of the present invention, when the trailing edge of the sheet of paper passes out of the space between the blanket cylinder 9 and the impression cylinder 10 and the printing pressure is thereby released as shown in FIG. 5A, gaps on the blanket cylinder 9 and on the collecting plate cylinder 13 are in contact with each other. Accordingly, it is possible to cause the displacement of the blanket cylinder 9 relative to the collecting plate cylinder 13 in the circumferential direction to occur in a range where the ink transfer between the cylinders 9 and 10 does not take place. Hence, the displacement causes no problem in ink transfer from the collecting plate cylinder 13 to the blanket cylinder 9, and no printing trouble occurs as a consequence.

Meanwhile, among the three transfer cylinders 6, 7, and 8 configured to convey the sheet of paper received from the swing 5 further to the impression cylinder 10 of the collect-printing section 2, the transfer cylinder 6 and the transfer cylinder 7 are provided with register adjustment mechanisms so that registration between an image printed in a precedent process and a pattern to be printed with the combination printing press of the present application can be achieved by positional adjustment of the sheet of paper using the transfer cylinders 6 and 7. To be more precise, the transfer cylinder 6 is provided with a skewing adjustment mechanism to be described below while the transfer cylinder 7 is provided with a not-illustrated circumferential adjustment mechanism.

As shown in FIG. 2, the skewing adjustment mechanism includes an eccentric bearing 102 rotatably fitted into a frame 200 so as to pivotally support one shaft end 6*a* of the transfer cylinder 6, and a not-illustrated drive device configured to rotate the eccentric bearing 102 via a connection mechanism having a flange portion 102*a*, a bracket 103, a link plate 104, and a pin 105. The skewing adjustment mechanism is configured to incline the shaft center of the transfer cylinder 6 with respect to the shaft center of the transfer cylinder 7 by rotating the eccentric bearing 102 with the drive device, and to pass a sheet of paper W onto the transfer cylinder 7 in an inclined state as shown in FIG. 4A. This is a mechanism which is made publicly known by Patent Document 4 and the like.

Meanwhile, as shown in FIG. 3, the circumferential adjustment mechanism includes: a first helical gear 217 supported movably in an axial direction and not rotatably relative to a shaft end 7*a* of the transfer cylinder 7, which is rotatably supported by the frame 200 via a bearing 202, via transmission shafts 203 and 204 that are spline-coupled to each other; and a drive device configured to move the first helical gear 217 in the axial direction of the transfer cylinder 7. The first helical gear 217 meshes with a second helical gear 218 which is rotated by a gear train of a not-illustrated drive motor.

The drive device includes a rotation ring 215 integrated with the transmission shaft 204, a screw pipe (a nut member) 208 into which the rotation ring 215 is fitted via a pair of right and left thrust bearings 216, a screw shaft 207 screwed into the screw pipe 208 and fixed to a sub-frame 206, a gear 209 meshing with an outer periphery of the screw pipe 207 and being rotatably and pivotally supported by the sub-frame 206, and a worm gear mechanism 212 connected to the gear 209 and configured to transmit torque of a not-illustrated adjustment motor. When the gear 209 is rotated via the worm gear mechanism 212 and the screw pipe 208 is thereby rotated, the screw pipe 208 axially moves in a direction corresponding to a direction of rotation thereof by means of a feed screw mechanism. Accordingly, the first helical gear 217 moves in the axial direction via the rotation ring 215.

Hence, when the drive device moves the first helical gear 217 in the axial direction, the first helical gear 217 moves on the shaft end of the transfer cylinder 7 while being rotated, and the rotation of the first helical gear 217 is transmitted to the transfer cylinder 7 and the transfer cylinder 7 is thereby turned. In this way, the transfer cylinder 7 is turned while the transfer cylinders 6 and 8 remain stationary. Thus, it is possible to perform phase adjustment of the transfer cylinder relative to the transfer cylinders 6 and 8, i.e., circumferential adjustment. Accordingly, as shown in FIG. 4B, the sheet of paper W can be passed onto the transfer cylinder 8 while being displaced in the circumferential direction (the circumferential direction of the transfer cylinder). The circumferential adjustment mechanism is a mechanism which is made publicly known by Patent Document 5 and the like.

In addition, an inkjet device 27 faces the transfer cylinder 7. The inkjet device 27 can perform printing of control numbers and the like on the transfer cylinder 7.

Second Embodiment

Figure 5B:
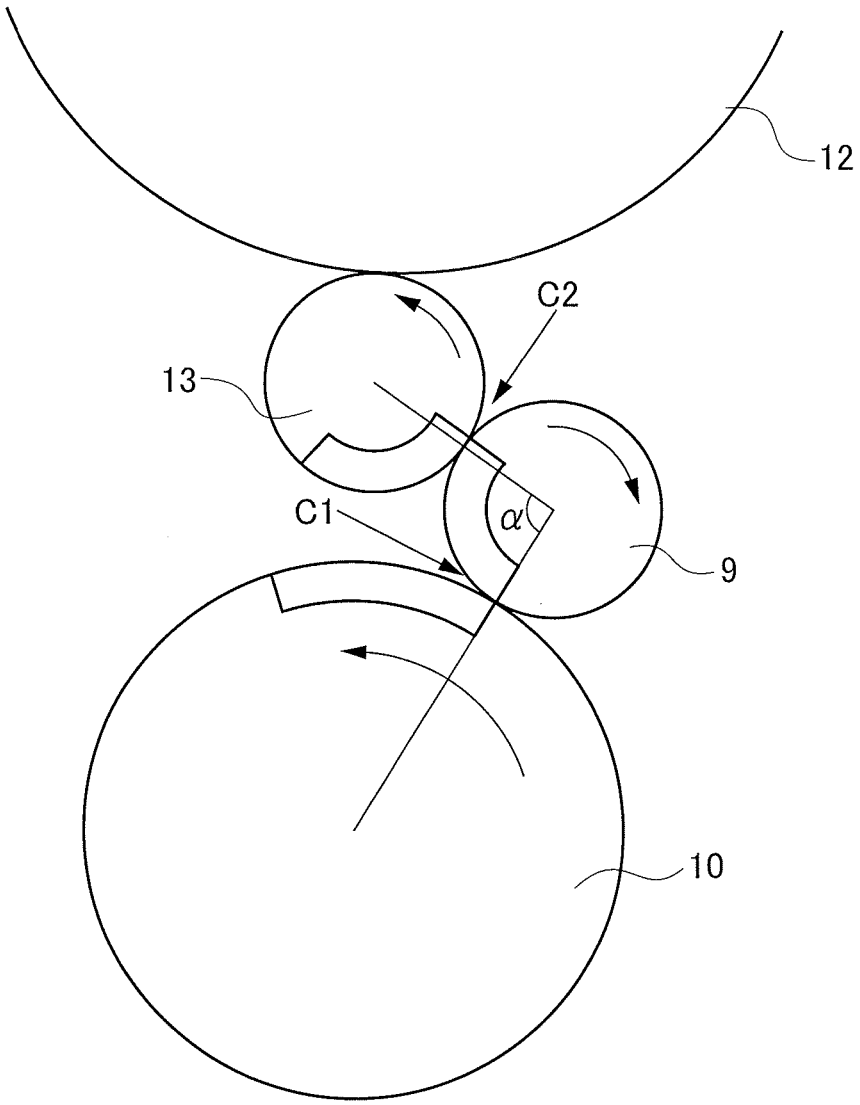
FIG. 5B is an explanatory view of an arrangement of cylinders in a collect-printing unit, which shows a second embodiment of the present invention.

FIG. 5B is an explanatory view of an arrangement of cylinders in a collect-printing unit, which shows a second embodiment of the present invention.

This embodiment is a modified example of the arrangement of cylinders in the collecting-printing unit of the first embodiment. Other features of the configuration of this embodiment are the same as those of the first embodiment and detailed description thereof will be omitted.

A difference from the arrangement of cylinders of the first embodiment is a position to dispose the blanket cylinder 9. Specifically, the blanket cylinder 9 is disposed upstream in the sheet conveyance direction (the feeder device side) of the collecting plate cylinder 13 which is disposed immediately below the collecting blanket cylinder 12.

In this way, a sufficient space (a second space) is secured on the upstream side in the sheet conveyance direction (the feeder device side) of the blanket cylinder 9. Thus, it is possible to perform the maintenance such as the cleaning work and the blanket replacement work from the upstream side in the sheet conveyance direction (the feeder device side) of the collect-printing unit 26. Meanwhile, the sufficient space Sb is secured on the downstream side in the sheet conveyance direction (the delivery device side) of the collecting plate cylinder 13. Thus, it is possible to perform the plate replacement from the downstream side in the sheet conveyance direction (the delivery device side) of the collect-printing unit 26.

Further, the impression cylinder 10, the blanket cylinder 9, and the collecting plate cylinder 13 of the collect-printing section 2 are arranged in such a way that a circumferential length of the blanket cylinder 9 between positions of contact with the collecting plate cylinder 13 and the impression cylinder 10 is equal to or below a non-printing length obtained by subtracting an effective printing length from the entire circumferential length of the blanket cylinder 9. Specifically, an angle α on the downstream side in the sheet conveyance direction (the delivery device side) defined between a line segment connecting the center of the impression cylinder 10 to the center of the blanket cylinder 9 and a line segment connecting the center of the blanket cylinder 9 to the center of the collecting plate cylinder 13 is set in such a way that the circumferential length from the position of contact of the blanket cylinder 9 with the collecting plate cylinder 13 to the position of contact of the blanket cylinder 9 with the impression cylinder 10 (a distance from a point where a sheet of paper is printed to a point where an ink is received from the collecting plate cylinder 13) becomes equal to or below the length (the non-printing length) obtained by subtracting the effective printing length (a length in the circumferential direction of the largest printing pattern printable with the printing press) from the entire circumferential length of the blanket cylinder 9.

In the meantime, as shown in FIG. 5B, a printing pressure (C2≈0.05 mm) between the blanket cylinder 9 and the collecting plate cylinder 13 is set lower than a printing pressure (C1≈0.15 mm) between the blanket cylinder 9 and the impression cylinder 10. Accordingly, a shock generated when a printing pressure is applied between the blanket cylinder 9 and the impression cylinder 10 as a result of transition of the cylinders 9 and 10 from a state where gaps thereon are in contact with each other to a state where effective impression areas thereof are opposed to each other with the sheet of paper sandwiched in between, causes a phenomenon to rotate the blanket cylinder 9 in its rotation direction or brake it forcibly, whereby the blanket cylinder 9 is displaced (slipped) relative to the collecting plate cylinder 13 in the circumferential direction.

However, in the configuration of the present invention, when the printing pressure is applied between the cylinders 9 and 10 as shown in FIG. 5B, the gaps on the blanket cylinder 9 and the collecting plate cylinder 10 are in contact with each other. Accordingly, it is possible to cause the displacement of the blanket cylinder 9 relative to the collecting plate cylinder 13 in the circumferential direction due to the forcible rotation or brake of the blanket cylinder 9 by the impression cylinder 10 to occur in a range where the ink transfer between the cylinders 9 and 10 does not take place. Hence, the displacement causes no problem in ink transfer from the collecting plate cylinder 13 to the blanket cylinder 9, and no printing trouble occurs as a consequence.

Third Embodiment

Figure 6:
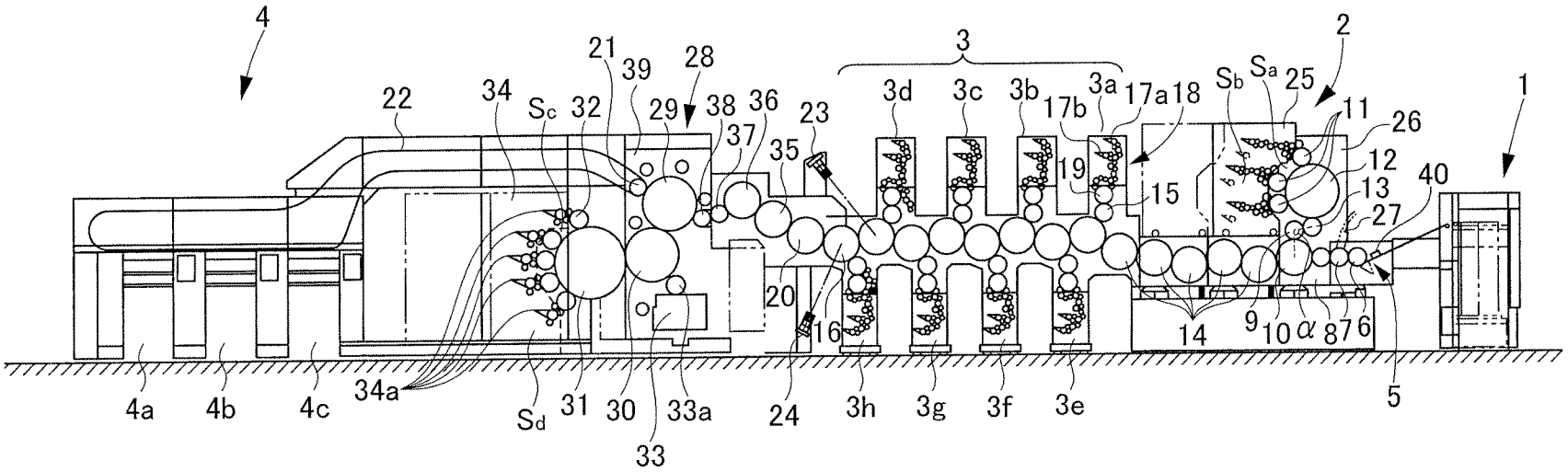
FIG. 6 is an overall configuration diagram of a combination printing press including a collect-printing press, which shows a third embodiment of the present invention.

FIG. 6 is an overall configuration diagram of a combination printing press, which shows a third embodiment of the present invention.

In this embodiment, an intaglio printing section is added to the combination printing press of the first embodiment. Other features of the configuration of this embodiment are the same as those of the first embodiment and detailed description thereof will be omitted.

A combination printing press of the embodiment is provided with an intaglio printing section 28 between the offset printing section 3 and the delivery section 4, and is configured to subject the sheet of paper, which has been subjected to collect-printing by the collect-printing section 2 and offset printing on one or both sides by the offset printing section 3, further to intaglio printing and to deliver the sheet of paper to the delivery section 4.

The intaglio printing section 28 includes an impression cylinder 29 configured to hold and convey the sheet of paper, an intaglio cylinder 30 having an intaglio plate attached on its peripheral surface, an ink collecting cylinder 31 configured to supply inks to the intaglio cylinder 30, a wiping device 33 having a wiping roller 33*a* configured to remove extra inks out of the inks transferred from the ink collecting cylinder 31 onto the intaglio plate on the intaglio cylinder 30, five chablon rollers 32 configured to supply the inks to the ink collecting cylinder 31, five ink supply devices 34*a* provided corresponding to the five chablon rollers 32 and configured to supply the inks to the chablon rollers 32, and an intaglio movable inking unit 34 supporting the five ink supply devices 34*a*. The intaglio printing section 28 is configured to perform intaglio printing on the sheet of paper that is fed in between the impression cylinder 29 and the intaglio cylinder 30.

The impression cylinder 29 of the intaglio printing section 28 is configured to receive the sheet of paper from the impression cylinder 16 of the reverse-side offset printing unit 3*h*, which is the final impression cylinder of the offset printing section 3, and via five transfer cylinders 20, 35, 36, 37, and 38, then to perform intaglio printing in a space defined with the intaglio cylinder 30, and to pass the sheet of paper onto the delivery cylinder 21.

The intaglio movable inking unit 34 supporting the five ink supply devices 34*a* is made capable of moving the ink supply devices to and away from (attaching and detaching the ink supply devices to and from) an intaglio printing unit 39 pivotally supporting the five chablon rollers 32, the ink collecting cylinder 31, the intaglio cylinder 30, and the impression cylinder 29.

Moreover, in the embodiment, a work space Sc, which enables an access to the ink collecting cylinder 31 at the time of maintenance such as cleaning work on the ink collecting cylinder 31 and blanket replacement work without dismounting the chablon rollers 32, is formed between adjacent chablon rollers 32.

In the illustrated example, the chablon rollers are arranged in such a way that an interval between the chablon roller located in the highest position among the five chablon rollers 32 and the chablon roller located immediately therebelow is made larger than an interval between the chablon rollers other than the highest chablon roller. Hence, in a position of separation (a position indicated with a chain double-dashed line in the drawing) of the intaglio movable inking unit 34, an operator located in a space Sd defined between the ink supply devices 34*a* and the chablon rollers 32 can access the ink collecting cylinder 31 through the work space Sc.

Specifically, the ink collecting cylinder 31 is accessible from the space Sd defined between the ink supply devices 34*a* and the chablon rollers 32 through the work space Sc. Thus, it is possible to access the ink collecting cylinder 31 by use of the work space Sc defined between the adjacent chablon rollers 32 without mounting and dismounting the chablon rollers 32 at the time of maintenance such as the cleaning work on the ink collecting cylinder 31 and the blanket replacement work, and thereby to perform the maintenance work on the ink collecting cylinder 31 easily.

The embodiment enables printing in an arbitrary combination of collect-printing, double-sided/single-sided offset printing, and/or intaglio printing. This makes it possible to meet more various printing demands and to perform high-quality printing with high register accuracy.

Needless to say, the present invention is not limited only to the above-described embodiments and various changes such as changes in the numbers of the transfer cylinders, the pattern plate cylinders, and the chablon rollers, are possible without departing from the gist of the invention.

INDUSTRIAL APPLICABILITY

A combination printing press according to the present invention can perform various types of printing in a single sheet conveyance operation of the single printing press, and can therefore be applied effectively to securities printing and so forth.

EXPLANATION OF REFERENCE NUMERALS

1 FEEDER SECTION
2 COLLECT-PRINTING SECTION
3 OFFSET PRINTING SECTION
3*a* to 3*d* OBVERSE-SIDE OFFSET PRINTING UNIT
3*e* to 3*h* REVERSE-SIDE OFFSET PRINTING UNIT
4 DELIVERY SECTION
4*a* DEFECTIVE SHEET PILE
4*b*, 4*c* NORMAL SHEET PILE
5 SWING
6 TRANSFER CYLINDER
7 TRANSFER CYLINDER
8 TRANSFER CYLINDER
9 BLANKET CYLINDER
10 IMPRESSION CYLINDER
11 PATTERN PLATE CYLINDER
12 COLLECTING BLANKET CYLINDER
13 COLLECTING PLATE CYLINDER
14 TRANSFER CYLINDER
15 BLANKET CYLINDER
16 IMPRESSION CYLINDER
17*a* INK FOUNTAIN
17*b* INK FOUNTAIN
18 DOUBLE-DUCT INK SUPPLY DEVICE
19 PLATE CYLINDER
20 TRANSFER CYLINDER
21 DELIVERY CYLINDER
22 DELIVERY CHAIN
23 OBVERSE-SIDE INSPECTION CAMERA
24 REVERSE-SIDE INSPECTION CAMERA
25 MOVABLE INKING UNIT
26 COLLECT-PRINTING UNIT
27 INKJET DEVICE
28 INTAGLIO PRINTING SECTION
29 IMPRESSION CYLINDER
30 INTAGLIO CYLINDER
31 INK COLLECTING CYLINDER
32 CHABLON ROLLER
33 WIPING DEVICE
33*a* WIPING ROLLER
34 INTAGLIO MOVABLE INKING UNIT
35 TRANSFER CYLINDER
36 TRANSFER CYLINDER
37 TRANSFER CYLINDER
38 TRANSFER CYLINDER
39 INTAGLIO PRINTING UNIT
40 SIDE LAY DEVICE
102 ECCENTRIC BEARING
102*a* FLANGE PORTION
103 BRACKET
104 LINK PLATE
105 PIN
200 FRAME
202 BEARING
203 TRANSMISSION SHAFT
204 TRANSMISSION SHAFT
206 SUB-FRAME
207 SCREW SHAFT
208 SCREW PIPE
209 GEAR
212 WORM GEAR MECHANISM
215 ROTATION RING
216 THRUST BEARING
217 FIRST HELICAL GEAR
218 SECOND HELICAL GEAR
Sa WORK SPACE
Sb SPACE
Sc WORK SPACE
Sd SPACE
$\alpha$ ANGLE

The invention claimed is:

1. A printing press comprising:

a collect-printing unit configured to perform collect-printing on a sheet, the collect-printing section comprises a collect-printing unit including:

a plurality of pattern plate cylinders;

a collecting blanket cylinder with which the plurality of pattern plate cylinders are in contact;

a collecting plate cylinder in contact with the collecting blanket cylinder;

a blanket cylinder in contact with the collecting plate cylinder;

an impression cylinder in contact with the blanket cylinder; and a movable inking unit configured to support a plurality of inking devices provided respectively corresponding to the plurality of pattern plate cylinders so as to supply inks to the pattern plate cylinders, in such a way as to be capable of moving the inking devices to and away from the pattern plate cylinders, wherein the blanket cylinder is a single-size cylinder, and the impression cylinder, the blanket cylinder, and the collecting plate cylinder are arranged in such a way that a length of a minor arc of the blanket cylinder between positions of contact of the blanket cylinder with the collecting plate cylinder and the impression cylinder is equal to or below a non-printing length obtained by subtracting an effective printing length from an entire circumferential length of the blanket cylinder.

2. The combination printing press according to claim 1, wherein an angle defined downstream, in a rotation direction of the blanket cylinder, of the position of contact between the impression cylinder and the blanket cylinder by a line segment connecting a center of the impression cylinder to a center of the blanket cylinder and a line segment connecting a center of the blanket cylinder to a center of the collecting plate cylinder is set in such a way that the length of the minor arc between the positions of contact of the blanket cylinder with the collecting plate cylinder and the impression cylinder is equal to or below the non-printing length obtained by subtracting the effective printing length from the entire circumferential length of the blanket cylinder.

3. The combination printing press according to claim 1, wherein an angle defined upstream, in a rotation direction of the blanket cylinder, of the position of contact between the impression cylinder and the blanket cylinder by a line segment connecting a center of the impression cylinder to a center of the blanket cylinder and a line segment connecting a center of the blanket cylinder to a center of the collecting plate cylinder is set in such a way that the length of the minor arc between the positions of contact of the blanket cylinder with the collecting plate cylinder and the impression cylinder is equal to or below the non-printing length obtained by subtracting the effective printing length from the entire circumferential length of the blanket cylinder.

* * * * *